US007445423B2

(12) United States Patent
Ishihara et al.

(10) Patent No.: US 7,445,423 B2
(45) Date of Patent: Nov. 4, 2008

(54) COUNTER-ROTATING AXIAL-FLOW FAN

(75) Inventors: Katsumichi Ishihara, Nagano (JP); Honami Oosawa, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 0 days.

(21) Appl. No.: 11/531,510

(22) Filed: Sep. 13, 2006

(65) Prior Publication Data

US 2007/0059155 A1 Mar. 15, 2007

(30) Foreign Application Priority Data

Sep. 14, 2005 (JP) ..... 2005-267423

(51) Int. Cl.
*F04D 19/02* (2006.01)
*F04D 29/38* (2006.01)

(52) U.S. Cl. ..... 415/61; 415/68; 415/193; 415/213.1; 415/214.1; 415/220; 415/208.2; 415/209.1; 415/211.2; 416/125; 416/128; 416/203

(58) Field of Classification Search ..... 415/60, 415/61, 66, 68, 69, 193, 199.4, 199.5, 213.1, 415/214.1, 220, 208.2, 209.1, 211.2; 416/120, 416/124, 125, 128, 198 R, 203
See application file for complete search history.

(56) References Cited

U.S. PATENT DOCUMENTS 2,313,413 A 3/1943 Weske
3,083,893 A * 4/1963 Dean ..... 415/68
4,729,714 A * 3/1988 Wrobel ..... 416/203
6,244,818 B1 6/2001 Chang
6,394,754 B1 * 5/2002 Choi ..... 416/238
6,540,479 B2 4/2003 Liao et al.
6,543,726 B2 4/2003 Illingworth
6,565,334 B1 5/2003 Bradbury et al.
6,612,817 B2 9/2003 Lin et al.
6,626,653 B2 * 9/2003 Lin et al. ..... 415/199.4
6,652,230 B1 11/2003 Huang et al.
6,663,342 B2 12/2003 Huang et al.

(Continued)

FOREIGN PATENT DOCUMENTS

JP 05-280489 10/1993
JP 2000-145695 5/2000
JP 2002-349476 12/2002
JP 2003-214388 7/2003
JP 2004-278370 10/2004
WO WO-2004/081387 A1 * 9/2004

*Primary Examiner*—Christopher Verdier
(74) *Attorney, Agent, or Firm*—Rankin, Hill & Clark LLP

(57) ABSTRACT

A first motor 25 rotates, in one of two rotating directions, the first impeller 7 including a plurality of front blades 28 in a suction opening portion 15 of a housing 59. The second motor 49 rotates, in the other rotating direction opposite to the one rotating direction, the second impeller 35 including a plurality of rear blades 51 in a discharge opening portion 57 of the housing 59. A plurality of stationary blades 61 are arranged between the first impeller 7 and the second impeller 35 in the housing 59. When the number of the front blades 28 is N, that of the stationary blades 61 is M, and that of the rear blades 51 is P, their relationship is defined as N>P>M. A length L1 of the front blades 28 measured in an axial direction is set longer than a length L2 of the rear blades 51 measured in the axial direction.

4 Claims, 8 Drawing Sheets

U.S. PATENT DOCUMENTS 6,799,942 B1 10/2004 Tzeng et al.
6,827,549 B1 12/2004 Horng et al.
6,904,960 B1 * 6/2005 Su et al. ..... 415/209.1
6,948,912 B2 * 9/2005 Chang et al. ..... 416/185
7,156,611 B2 * 1/2007 Oosawa et al. ..... 415/68
2001/0036406 A1 11/2001 Illingworth
2004/0228722 A1 11/2004 Horng et al.
2005/0106026 A1 5/2005 Oosawa et al.

* cited by examiner

*Prior Art*

COUNTER-ROTATING AXIAL-FLOW FAN

BACKGROUND OF THE INVENTION

The present invention relates to a counter-rotating axial-flow fan used to cool an interior of an electric appliance.

As an electric appliance becomes smaller in size, so does a space inside a case of the electric appliance in which air flows. To cool an interior of the small case, a fan with features of a large amount of air and a high static pressure is called for. As a fan with such features, a counter-rotating axial-flow fan has come to be used in recent years.

For example, Japanese Patent Publication No. 2004-278370(US2005/0106026) (FIG. 1) shows a conventional counter-rotating axial-flow fan of this kind.

In recent years some applications call for higher performance than that of the existing counter-rotating axial-flow fan.

SUMMARY OF THE INVENTION

An object of the present invention is to provide a counter-rotating axial-flow fan which is capable of producing a larger amount of air and a higher static pressure than conventional fans do.

The counter-rotating axial-flow fan or axial-flow fan with double impellers rotating in mutually opposite directions of this invention comprises a housing, a first impeller, a first motor, a second impeller, a second motor, and a plurality of stationary blades. The housing includes an air channel which has a suction opening portion at one side in an axial direction thereof and a discharge opening portion at the other side in the axial direction. The first impeller includes a plurality of front blades that rotate in the suction opening portion. The first motor rotates the first impeller about an axial line of the fan in one of two rotating directions. The second impeller has a plurality of rear blades that rotate in the discharge opening portion. The second motor rotates the second impeller about the axial line in the other rotating direction opposite to the one rotating direction. The stationary blades are arranged stationary in the housing between the first impeller and the second impeller and extend radially. Here, the word "radially" applies to not only a case where the blades extend radially in straight lines but also a case where they extend radially in curved lines. In the counter-rotating axial-flow fan of the present invention, the number of the plurality of front blades is defined to be N, the number of the plurality of stationary blades is defined to be M, and the number of the plurality of rear blades is defined to be P. Each of N, M and P is a positive integer, and their relationship is defined as N>P>M.

In the counter-rotating axial-flow fan of this invention, a length L1 of each of the N front blades, measured in the axial direction is defined to be longer than a length L2 of each of the P rear blades, measured in the axial direction. A relationship between the length L1 and the length L2 has been studied. The finding is that a larger amount of air and a higher static pressure can be generated when the length L1 is set longer than the length L2. In the counter-rotating axial-flow fan of this invention, the air amount and the static pressure can be increased, compared with conventional fans.

The first impeller includes an annular member having a peripheral wall on which N blades are mounted and disposed at a predetermined interval in a circumferential direction. End portions of the N blades, located at the other side in the axial direction, extend toward the other side beyond an end portion of the peripheral wall of the annular member, located at the other side in the axial direction. The second impeller includes an annular member having a peripheral wall on which the P blades are mounted and disposed at a predetermined interval in a circumferential direction. End portions of the P blades, located at the one side in the axial direction, do not substantially extend beyond an end portion of the peripheral wall of the annular member located at the one side in the axial direction. End portions of the P blades, located at the other side in the axial direction, do not substantially extend beyond the end portion of the peripheral wall of the annular member located at the other side in the axial direction.

The housing may be formed as one integral structure but it may also be formed of two or more constitutional parts. For example, when the counter-rotating axial-flow fan of this invention is made by coupling two axial-flow fan units, the housing is constructed by coupling the cases of the two axial-flow fan units.

When a first axial-flow fan unit and a second axial-flow fan unit are coupled together to form the counter-rotating axial-flow fan, the first axial-flow fan unit includes a first case, a first impeller, a first motor and a plurality of webs. The first case includes an air channel having a suction opening portion at one side in an axial direction thereof and a discharge opening portion at the other side in the axial direction. The first impeller includes a plurality of front blades that rotate in the suction opening portion. The first motor rotates the first impeller about the axial line in one of two rotating directions. The plurality of webs are located in the discharge opening portion and disposed at a predetermined interval in a circumferential direction to fix the first motor to the first case. Similarly, the second axial-flow fan unit includes a second case, a second impeller, a second motor and a plurality of webs. The second case includes an air channel having a suction opening portion at one side in an axial direction thereof and a discharge opening portion at the other side in the axial direction. The second impeller includes a plurality of rear blades that rotate in the discharge opening portion. The second motor rotates the second impeller about the axial line in the other rotating direction opposite to the one rotating direction. The plurality of webs are located in the suction opening portion and disposed at a predetermined interval in a circumferential direction to fix the second motor to the second case. The first case of the first axial-flow fan unit and the second case of the second axial-flow fan unit are coupled together to form the housing. In that case, the plurality of webs of the first axial-flow fan unit and the plurality of webs of the second axial-flow fan unit are preferably coupled to form a plurality of radially extending stationary blades arranged stationary in the housing between the first impeller and the second impeller. With this arrangement, there is no need to construct a case having a plurality of stationary blades separately from the axial-flow fan units, reducing the number of parts used in the counter-rotating axial-flow fan. Further, compared with a case where a separate unit having a plurality of stationary blades is used, the counter-rotating axial-flow fan of this invention can be reduced in an axial overall size.

Specifically, in the present invention a length L3 of the first case, measured in the axial direction is defined to be longer than a length 4 of the second case, measured in the axial direction. The lengths L1 and L2 are defined so that a ratio of the two lengths L1/L2 is 1.3 to 2.5. The lengths L3 and L4 are defined so that a ratio of the two lengths L3/L4 is 1.2 to 1.8.

More specifically, the front blades are curved in a transverse cross section of the front blades as taken along a direction parallel to the axial line (or along the axial line) so that their concave portions are open toward the rotating direction of the first impeller, i.e. in the one rotating direction as described above. The rear blades are curved in a transverse cross section of the rear blades as taken along a direction parallel to the axial line so that their concave portions are open toward the rotating direction of the second impeller, i.e. in the other rotating direction as described above. In this construction, the stationary blades are preferably curved in a transverse cross section of the stationary blades as taken along a direction parallel to the axial line so that their concave portions are open toward the other rotating direction (the rotating direction of the second impeller) and toward a direction in which the rear blades are located. With this arrangement, it is possible to increase the maximum amount of air and the maximum static pressure while reducing the suction noise.

More specifically, the first impeller may include an annular member having a peripheral wall surrounding the axial line on which base portions of five front blades are integrally mounted. The second impeller may include an annular member having a peripheral wall surrounding the axial line on which base portions of four rear blades are integrally mounted. This arrangement allows the first and second impellers to be formed easily by resin injection molding.

The rotating speed of the second impeller is preferably set slower than that of the first impeller for reducing noise.

In the counter-rotating axial-flow fan of the present invention, a length L1 of each of the N front blades, measured in the axial direction is set longer than a length L2 of each of the P rear blades, measured in the axial direction. Then the air amount and the static pressure can be increased, compared with conventional fans.

DETAILED DESCRIPTION OF PREFERRED EMBODIMENTS

Figure 1A:
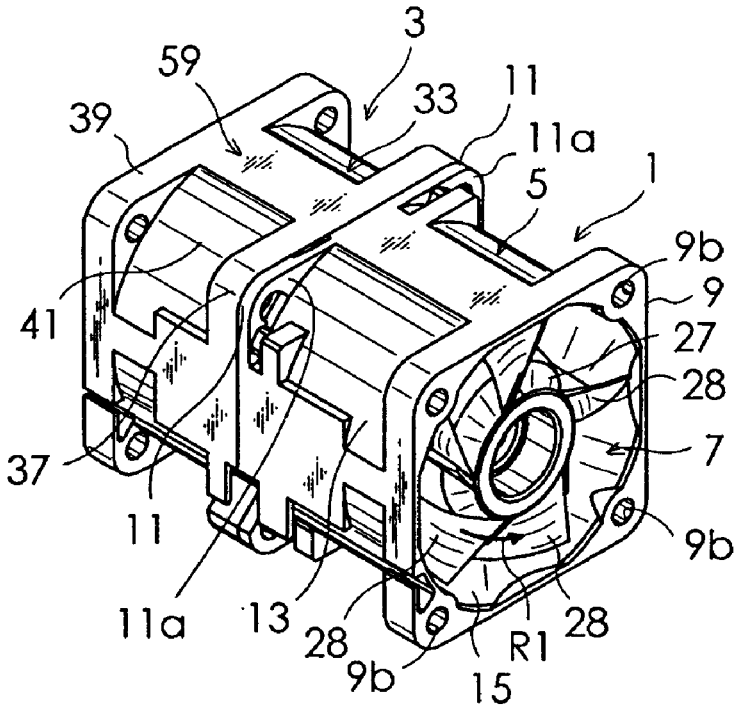
FIGS. 1A, 1B, 1C, 1D and 1E are a perspective view as viewed from a suction opening portion, a perspective view as viewed from a discharge opening portion, a front side elevation view as viewed from the suction opening portion, a rear side elevation view as viewed from the discharge opening portion and the right side elevation view of the front side elevation view respectively of a counter-rotating axial-flow fan of one embodiment of the present invention.
Figure 1B:
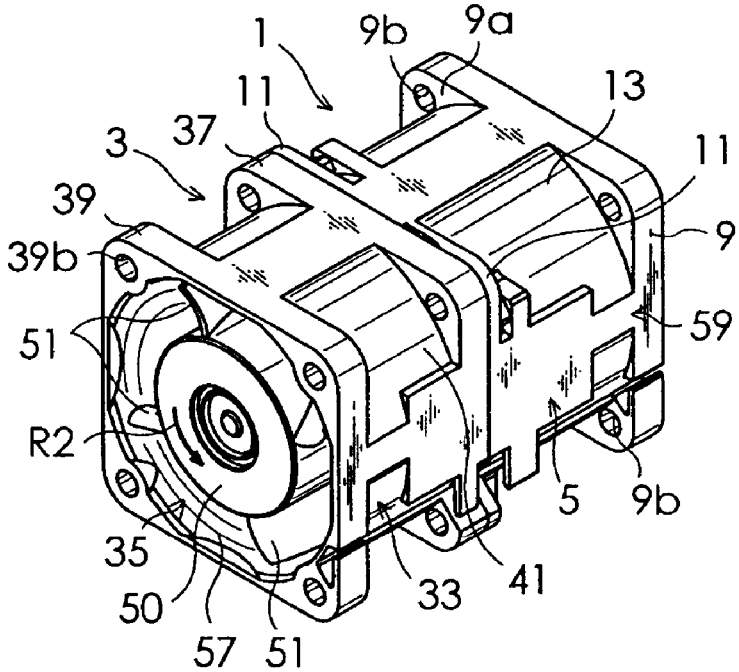
Figure 1C:
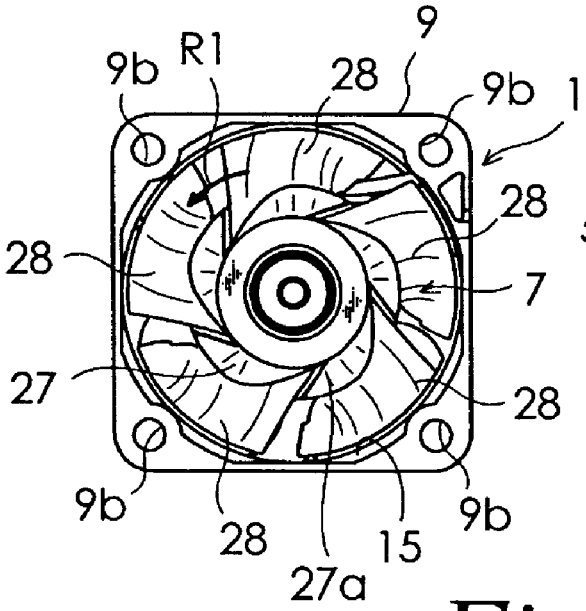
Figure 1D:
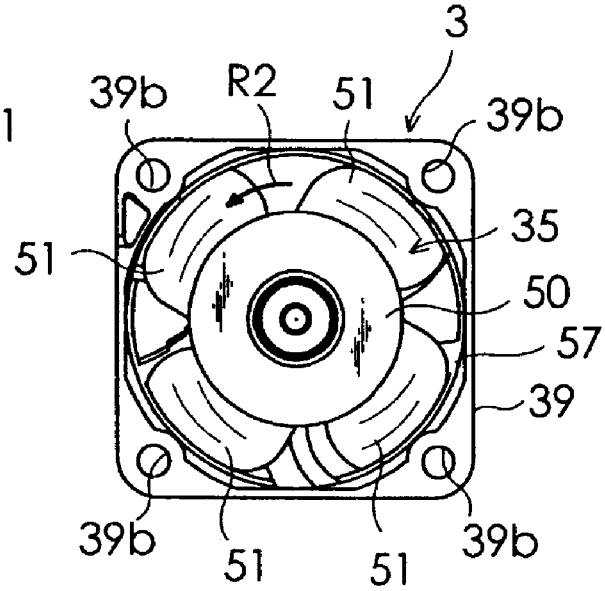
Figure 1E:
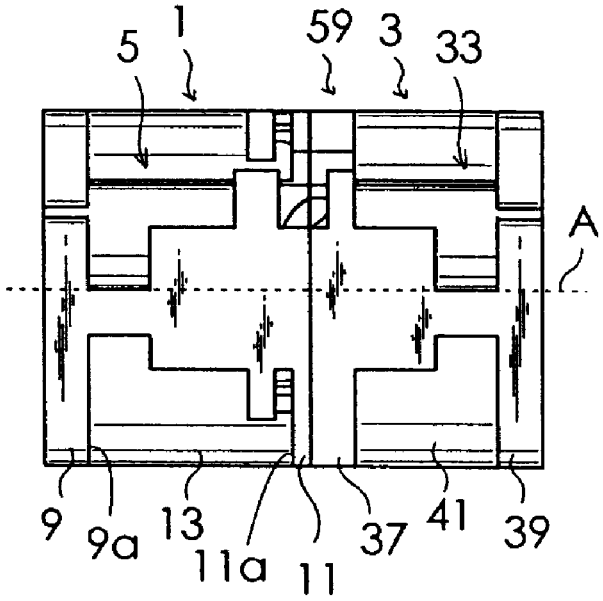
Figure 2:
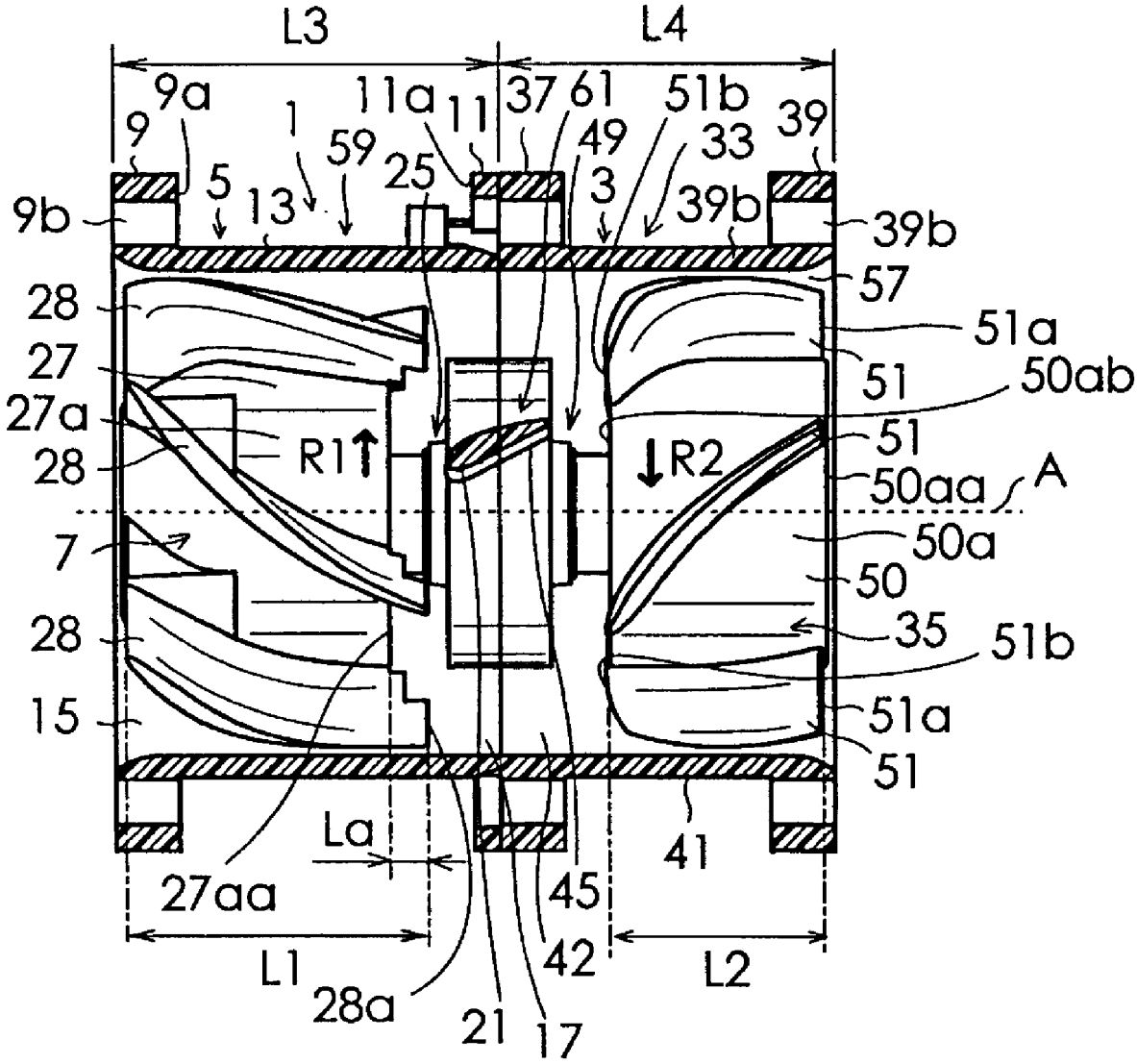
FIG. 2 is a vertical cross-sectional view of the counter-rotating axial-flow fan in this embodiment.
Figure 3:
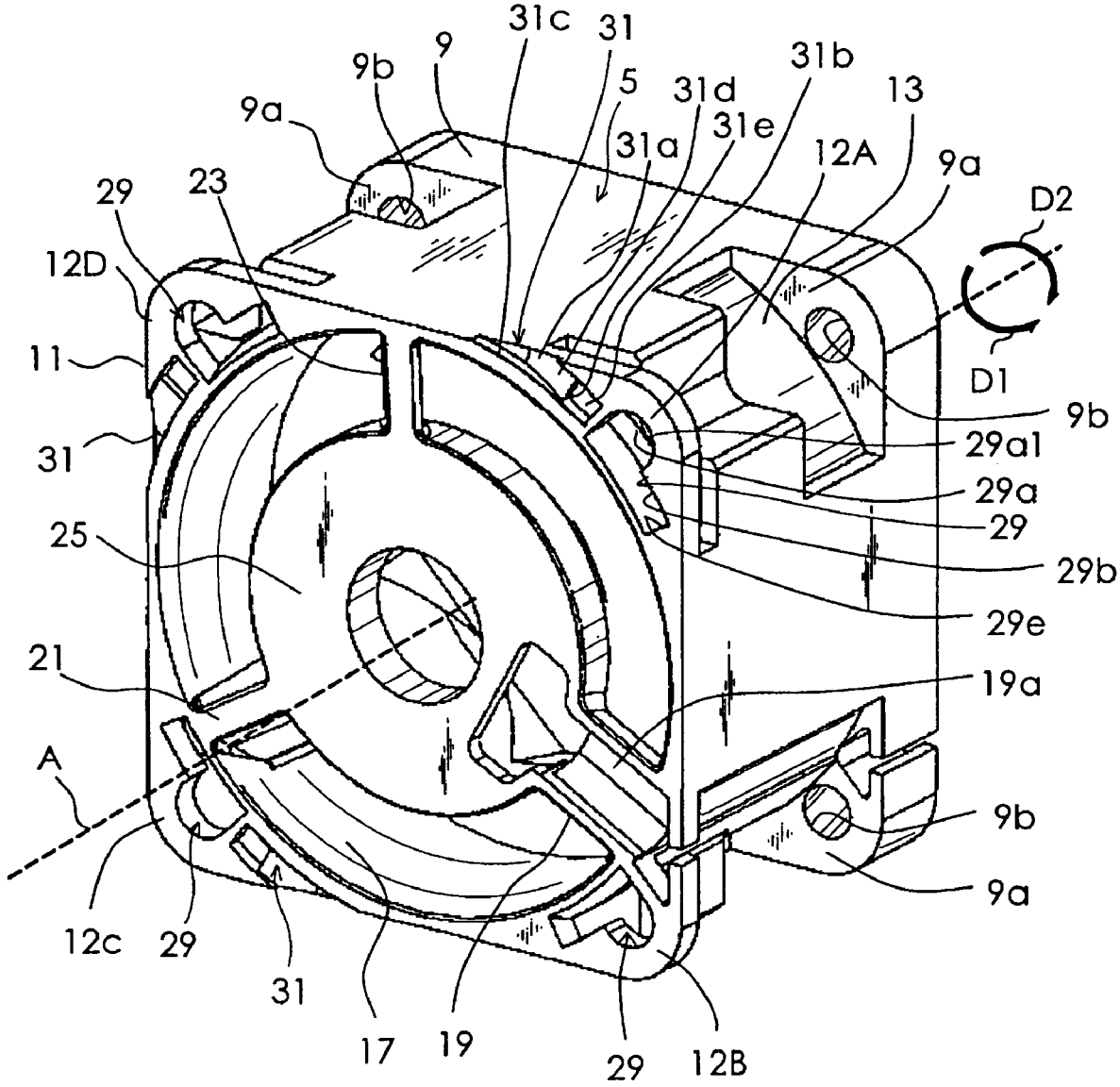
FIG. 3 is a perspective view showing a first axial-flow fan unit in this embodiment.
Figure 4:
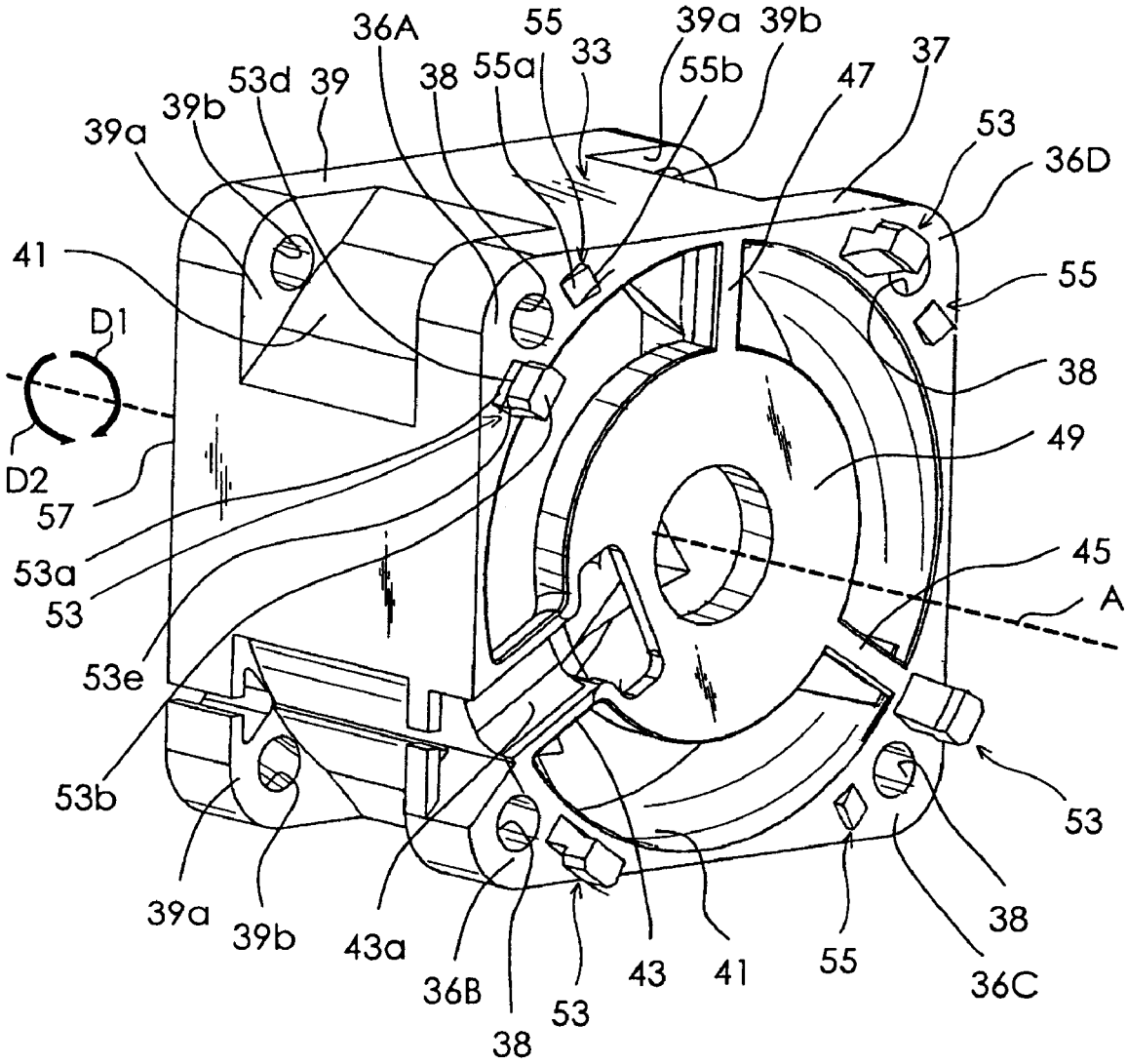
FIG. 4 is a perspective view showing a second axial-flow fan unit in this embodiment.
Figure 5:
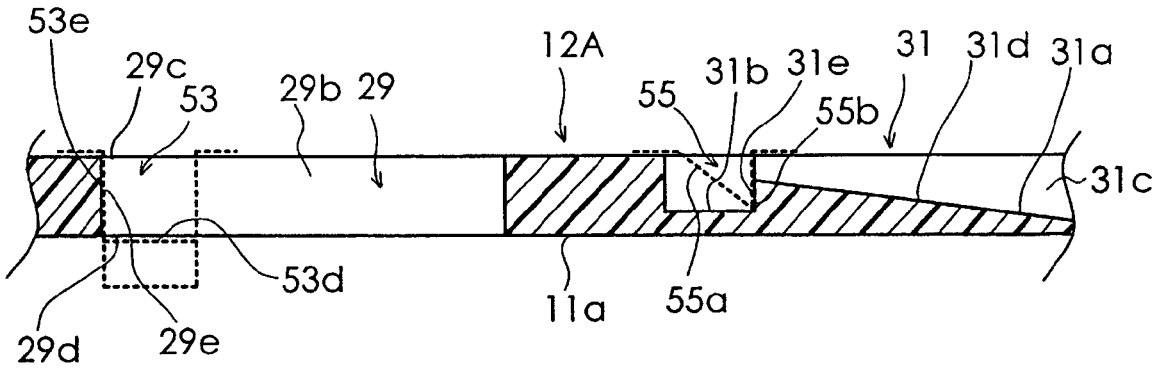
FIG. 5 is an enlarged vertical cross-sectional view for illustrating a coupling structure of the counter-rotating axial-flow fan in this embodiment.
Figure 6:
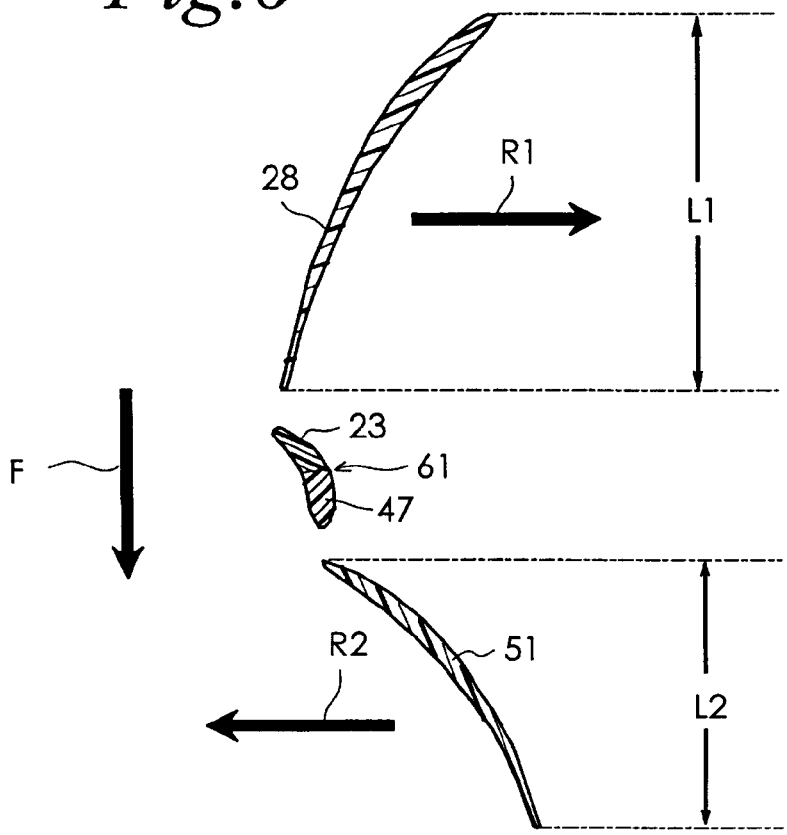
FIG. 6 is a transverse cross-sectional view of a front blade, a rear blade and a stationary blade when the counter-rotating axial-flow fan is cut in a direction parallel to an axial direction in this embodiment.

Now, an embodiment of the present invention will be described in detail by referring to FIGS. 1A to 1E through FIG. 6. FIGS. 1A, 1B, 1C, 1D and 1E are a perspective view as viewed from a suction opening portion, a perspective view as viewed from a discharge opening portion, a front side elevation view as viewed from the suction opening portion, a rear side elevation view as viewed from the discharge opening portion and the right side elevation view of the front side elevation view respectively of a counter-rotating axial-flow fan of one embodiment of the present invention. FIG. 2 is a vertical cross-sectional view of the counter-rotating axial-flow fan in this embodiment. FIG. 3 is a perspective view showing a first axial-flow fan unit in this embodiment. FIG. 4 is a perspective view showing a second axial-flow fan unit in this embodiment. FIG. 5 is an enlarged vertical cross-sectional view for illustrating a coupling structure of the counter-rotating axial-flow fan in this embodiment. FIG. 6 is a transverse cross-sectional view of a front blade, a rear blade and a stationary blade when the counter-rotating axial-flow fan is cut in a direction parallel to an axial direction in this embodiment.

A counter-rotating axial-flow fan of this embodiment is constructed via a coupling structure of the first axial-flow fan unit 1 and the second axial-flow fan unit 2.

The first axial-flow fan unit 1 has a first case 5, a first impeller (front impeller) 7, a first motor 25, and three webs 19, 21, 23 spaced apart 120 degrees circumferentially, all of which are arranged in the first case 5. The first case 5 has an annular suction-side flange 9 at one side in the axial direction in which the axial line A extends and an annular discharge-side flange 11 at the other side. The first case 5 also has a cylindrical portion 13 between the two flanges 9, 11. The flanges 9, 11 and an inner space in the cylindrical portion 13 all together form an air channel.

FIG. 3 is a perspective view of the first case 5 of the first axial-flow fan unit 1 as seen from the coupled portion between the first case 5 and the second axial-flow fan unit 3 by separating the second axial-flow fan unit 3 from the first axial-flow fan unit 1 of the counter-rotating axial-flow fan of FIG. 1A to 1E. The suction flange 9 has an almost rectangular outline, with a circular suction opening portion 15 formed therein. The suction flange 9 has, at its four corner portions, flat faces 9*a* facing toward the cylindrical portion 13 and through-holes 9*b* for mounting screws.

The discharge flange 11 also has an almost rectangular outline with a circular discharge opening portion 17 formed therein. In the discharge opening portion 17, three radially extending webs 19, 21, 23 are arranged at circumferentially equal intervals. Through the three webs 19, 21, 23, a motor case in which a stator of the first motor 25 is fixed is secured to the first case 5. Of the three webs 19, 21, 23, the web 19 has a groove-shaped recessed portion 19*a* opening toward the second axial-flow fan unit 3. In this recessed portion 19*a* is installed a feeder wire not shown which is connected to an excitation winding of the first motor 25. The three webs 19, 21, 23 are respectively combined with three webs 43, 45, 47, described later, of the second axial-flow fan unit 3 to form M stationary blades 61, three in the embodiment, (FIG. 6) described later.

The first motor 25 comprises a rotor not shown, to which the first impeller 7 of FIG. 2 is mounted, and a stator for rotating the rotor. The first motor 25 rotates the first impeller 7 in the suction opening portion 15 of the first case 5 counterclockwise in FIG. 1 (i.e., in a direction of arrow R1, or in one rotating direction). The first motor 25 rotates the first impeller 7 at a speed faster than a second impeller 35 described later. The first impeller 7 has an annular member 27 fitted with a cup-shaped member, not shown, of the rotor which is fixed onto a shaft, not shown, of the first motor 25, and N front blades 28, five in the embodiment, integrally provided on an outer peripheral surface of an annular wall 27*a* of the annular member 27.

The discharge-side flange 11 has flat faces 11*a* formed at each of four corner portions 12A to 12D facing the cylindrical portion 13. At the four corner portions 12A to 12D are formed four first fitting grooves 29 that constitute engaged portions of a first kind, as shown in FIG. 3. These first fitting grooves 29 are formed by through-holes passing through the discharge-side flange 11. Here a construction of the first fitting groove 29 formed in the corner portion 12A will be explained. The first fitting groove 29 has a hook passing hole 29*a* and a hook moving hole 29*b* contiguous with the hook passing hole 29*a*. The hook passing hole 29*a* has a semi-arc portion 29*al* which also serves as a through-hole through which a mounting screw passes. The hook moving hole 29*b* is shaped like an arc. At end portion 29*c* when seen in the rotating direction R1 of the first impeller 7, the hook moving hole 29*b*, as shown in FIG. 5, is formed with a first engaged surface 29*d* and a second engaged surface 29*e* to be engaged by a hook 53 described later. FIG. 5 is a partial cross-sectional view of the corner portion 12A as taken along the first fitting groove 29 and a second fitting groove 31 described later. The first engaged surface 29*d* is situated at the corner portion 12A and is formed by a part of the flat face 11*a* situated close to the end portion 29*c* of the hook moving hole 29*b*. The second engaged surface 29*e* is formed of an end face, at the rotating direction side, of the hook moving hole 29*b*.

Except for the corner portion 12B adjacent to the web 19 in which a wire not shown is installed, the plurality of corner portions 12A, 12C, 12D are each formed with a second fitting groove 31 that constitutes an engaged portion of a second kind. As shown in FIG. 5, the second fitting groove 31 has a protrusion moving groove 31*a* and an engaging groove 31*b* contiguous with the protrusion moving groove 31*a*. The protrusion moving groove 31*a* has an opening 31*c* opening toward a side surface of the discharge-side flange 11. The protrusion moving groove 31*a* has a bottom surface 31*d* which is sloping in such a manner that the bottom surface becomes closer to the second axial-flow fan unit 3 as it extends from the opening 31*c* toward the engaging groove 31*b*. As a result, a step is formed between the engaging groove 31*b* and the protrusion moving groove 31*a*. An inner surface of the engaging groove 31*b* situated at the protrusion moving groove 31*a* side constitutes a third engaged surface 31*e*.

The second axial-flow fan unit 3 has a second case 33, a second impeller (rear impeller) 35 in FIG. 2, a second motor 49 in FIG. 2 and FIG. 4, and three webs 43, 45, 47 in FIG. 4, all of which are arranged in the second case 33. The second case 33, as shown in FIG. 1 and FIG. 4, has a suction-side flange 37 at one side in the axial direction in which the axial line A extends and a discharge-side flange 39 at the other side. The second case 33 also has a cylindrical portion 41 between the two flanges 37, 39. The flanges 37, 39 and an inner space in the cylinder portion 41 all together form an air channel. FIG. 4 is a perspective view of the second case 33 of the second axial-flow fan unit 3 as seen from the coupled portion between the second case 33 and the first axial-flow fan unit 1, which is separated from the second axial-flow fan unit 3 of the counter-rotating axial-flow fan in FIG. 1 and FIG. 2.

The suction-side flange 37 has an almost rectangular outline, with a circular suction opening portion 42 formed therein. In the suction opening portion 42, three radially extending webs 43, 45, 47 are arranged at circumferentially equal intervals. The second motor 49 is secured to the second case 33 through the plurality of webs 43, 45, 47. Of the plurality of webs 43, 45, 47, the web 43 has a groove-shaped recessed portion 43*a* opening toward the first axial-flow fan unit 1. In this recessed portion 43*a* is installed a feeder wire not shown which is connected to an excitation winding of the second motor 49. The three webs 43, 45, 47 combine respectively with three webs 19, 21, 23 of the first axial-flow fan unit 1 to form M stationary blades 61 (three in the embodiment) described later.

The second motor 49 comprises a rotor not shown to which the second impeller 35 of FIG. 2 is mounted and a stator that rotates this rotor. The second motor 49 rotates the second impeller 35 in a discharge opening portion 57 clockwise in FIG. 2 [in the direction of arrow R2 in the figure, i.e., in a direction opposite to the rotating direction (an arrow R1) of the first impeller 7]. As described above, the second impeller 35 is rotated at a speed slower than that of the first impeller 7.

The second impeller 35 has an annular member 50 fitted with a cup-shaped member, not shown, of the rotor which is secured to a shaft, not shown, of the second motor 49, and P rear blades 51 (four in the embodiment) integrally provided on an outer peripheral surface of an annular wall 50*a* of the annular member 50.

Four corner portions 36A to 36D of the suction-side flange 37 are formed with a through-hole 38 through which a mounting screw passes, as shown in FIG. 4. Each of the four corner portions 36A to 36D also has a hook 53 formed integrally therewith which constitutes an engaging portion of a first kind. The hooks 53 protrude toward the first case 5. The construction of the hook 53 at the corner portion 36A will be explained. The hook 53 has a body portion 53*a* rising along the axial line A from the corner portion and a head portion 53*b* attached at an end of the body portion 53*a*. The head portion 53*b* at the end of the body portion 53*a* protrudes outwardly in a radial direction, gradually away from the axial line A, thus forming a step between the head portion 53*b* and the body portion 53*a*. A surface of this step forms a first engaging surface 53*d* that engages with the first engaged surface 29*d* shown in FIG. 5. Except for the corner portion 36B adjacent to the web 43, the plurality of corner portions 36A, 36C, 36D are each formed integrally with a protrusion 55 to constitute an engaging portion of a first kind in such a manner that the through-hole 38 is located between the hook 53 and the protrusion 55. The protrusion 55 protrudes toward the first case 5 along the axial line A, as with the hooks 53. The protrusion 55 has an inclined surface 55*a* which inclines in such a manner that the inclined surface becomes closer to the first case 5 as it departs away from the hook 53 situated in the same corner portion. This inclined surface 55*a* slides on a sloped surface forming the bottom surface 31*d* of the protrusion moving groove 31*a* shown in FIG. 5. The protrusion 55 has an end face 55*b* extending along the axial line from an end of the inclined surface 55*a* toward the second case 33. This end face 55*b* forms a third engaging surface that engages with the third engaged surface 31*e* formed in the engaging groove 31*b*.

As shown in FIG. 4, the discharge-side flange 39 has an almost rectangular outline, with a circular discharge opening portion 57 formed therein. The discharge-side flange 39 has flat faces 39*a* formed at each of the four corner portions at the side of the cylinder portion 41. The four corner portions are each formed with a through-hole 39*b* through which a mounting screw passes.

FIG. 6 shows a front blade 28, a rear blade 51 and a stationary blade 61 in a transverse cross-sectional view as taken along a direction parallel to the axial line, with the first case 5 and the second case 33 coupled together. In the example shown in FIG. 6, the stationary blade 61 is formed by coupling the web 23 of the first axial-flow fan unit 1 and the web 47 of the second axial-flow fan unit 3. As shown in the figure, the front blade 28 is curved in the transverse cross section so that its concave portion opens toward the direction R1 while the rear blade 51 is curved in the transverse cross section so that its concave portion opens toward the other direction R2. The stationary blade 61 is curved in the transverse cross section so that its concave portion opens toward the other direction R2 and also toward a direction in which the rear blade 51 is located.

When the number of the front blades 28 is N, that of the stationary blades 61 is M, and that of the rear blades 51 is P, each of N, M and P is a positive integer, and a relationship among N, M and P is defined as N>P>M in the counter-rotating axial-flow fan of the present invention. Since N=5, P=4 and M=3 in this embodiment, the relationship among N, M and P is 5>4>3.

Specifically in the counter-rotating axial-flow fan of the present invention, a length L1, of each the N front blades 28 of the first axial-fan unit 1, measured in an axial direction is set longer than the length L2, of each the P rear blades 51 of the second axial-fan unit 3, measured in the axial direction as shown in FIG. 2.

More specifically, end portions 28*a* of the N front blades 28 of the first axial-fan unit 1, located at the other side in the axial direction (at the discharge opening portion 17), extend toward a direction of the other side (at the discharge opening portion 17) beyond an end portion 27*aa* of the peripheral wall 27*a* of the annular member 27, located at the other side in the axial direction (at the discharge opening portion 17). End portions 51*b* of the rear P blades 51 of the second axial-flow fan unit 3, located at the one side in the axial direction (at the suction opening portion 42), do not substantially extend beyond an end portion 50*ab* of the peripheral wall 50*a* of the annular member 50 located at the one side in the axial direction (at the suction opening portion 42). End portions 51*a* of the rear P blades, located at the other side in the axial direction (at the discharge opening portion 57), do not substantially extend beyond the end portion 50*aa* of the peripheral wall 50*a* of the annular member 50 located at the other side in the axial direction (at the discharge opening portion 57).

Each of the end portions 28*a*, of the N front blades 28, located at the other side (at the discharge opening portion 17) in the axial direction extends beyond the end portion 27*aa*, of the peripheral wall 27*a* of the annular member 27, located at the other side (at the discharge opening portion 17) in the axial direction. A length L*a* of an extended part for each of the end portions 28*a* of the N front blades 28, which extends toward the other side in the axial direction beyond the end portion 27*aa* of the peripheral wall 27*a* of the annular member 27 is within a range from 10 percent to 15 percent of the length L1.

A length L3 of the first case 5 measured in the axial direction A is set longer than a length L4 of the second case 3 measured in the axial direction. The length L3 is set longer than the length L4. In this embodiment, the length L3 is set to 30 millimeter and the length L4 is set to 26 millimeter. Preferably the length L3 and the length L4 are determined so that a ratio of the two lengths L3/L4 is a value from 1.2 to 1.8.

In this embodiment of the fan, the first case 5 of the first axial-flow fan unit 1 and the second case 33 of the second axial-flow fan unit 3 are coupled as follows. First, the end portion of the first case 5 and the end portion of the second case 33 are brought close together, and the head portions 53*b* of the four hooks 53 of the second case 33 are inserted into the corresponding hook passing holes 29*a* of the four first fitting grooves 29 in the first case 5. At this time, the plurality of protrusions 55 of the second case 33 fit into the openings 31*c* of the plurality of second fitting grooves 31 in the first case 5. Next, as shown in FIG. 3 and FIG. 4, these cases 5, 33 are rotated clockwise in one rotating direction (indicated by arrow D1) relative to each other. This rotation may be achieved either by rotating both of the cases or only one case relative to the other. This rotation causes the body portions 53*a* of the hooks 53 to move in the hook moving holes 29*b* of the first fitting grooves 29 until the first engaging surfaces 53*d* of the head portions 53*b* of the hooks 53 abut onto the first engaged surfaces 29*d* at the flat faces 11*a* of the discharge-side flange 11 and the second engaging surfaces 53*e* of the body portions 53*a* abut onto the second engaged surfaces 29*e* of the discharge-side flange 11, thus preventing the hooks 53 from coming off the first fitting grooves 29. Further, the protrusions 55 move in the protrusion moving grooves 31*a* of the second fitting grooves 31 until they fit into the engaging grooves 31*b*. The end faces 55*b* of the protrusions 55 engage with the third engaged surfaces 31*e* formed in the engaging grooves 31*b*.

In this embodiment, the hooks 53 (engaging portions of first kind) and the first fitting grooves 29 (engaged portions of first kind) are coupled to form an engaging structure of first kind. The protrusions 55 (engaging portions of second kind) and the second fitting grooves 31 (engaged portions of second kind) are coupled to form a second kind of an engaging structure. With this construction, when a separating action to move in the axial direction the first case 5 and the second case 33 out of engagement with each other, the first engaging surfaces 53*d* of the head portions 53*b* of the hooks 53 engage with the first engaged surfaces 29*d* at the flat faces 11*a* of the discharge-side flange 11, activating the first kind of engaging structure to resist the separating action. Further, when a first rotating action is performed to rotate the first case 5 and the second case 33, in a coupled state, about the axial line A in one rotating direction indicated by arrow D1, the second engaging surfaces 53*e* of the body portions 53*a* engage with the second engaged surface 29*e* of the discharge-side flange 11, activating the first kind of engaging structure to resist the first rotating action. When a second rotating action is performed to rotate the first case 5 and the second case 33, in a coupled state, about the axial line A in a direction indicated by arrow D2, opposite to the one rotating direction (arrow D1), the end faces 55*b* of the protrusions 55 forming the third engaging surfaces engage with the third engaged surfaces 31*e* of the engaging grooves 31*b* of the second fitting grooves 31, activating the second kind of engaging structure to resist the second rotating action. Thus, in the fan of this embodiment, even if the first case 5 and the second case 33 are subjected to a force acting in the direction of arrow D1 or a force acting in the direction of arrow D2, they are prevented from being disconnected.

As shown in FIG. 1 and FIG. 2, in the fan of this embodiment, the first case 5 and the second case 33 are coupled to form a housing 59; and the webs 19, 21, 23 of the first axial-flow fan unit 1 and the webs 43, 45, 47 of the second axial-flow fan unit 3 are coupled to form a plurality of radially extending stationary blades 61 (FIG. 6) disposed stationarily in the housing 59 between the first impeller 7 and the second impeller 35. When the first impeller 7 rotates in one rotating direction R1 and the second impeller 35 in the other rotating direction R2, air is moved in a direction F from the suction opening portion 15 toward the discharge opening portion 57.

Figure 7:
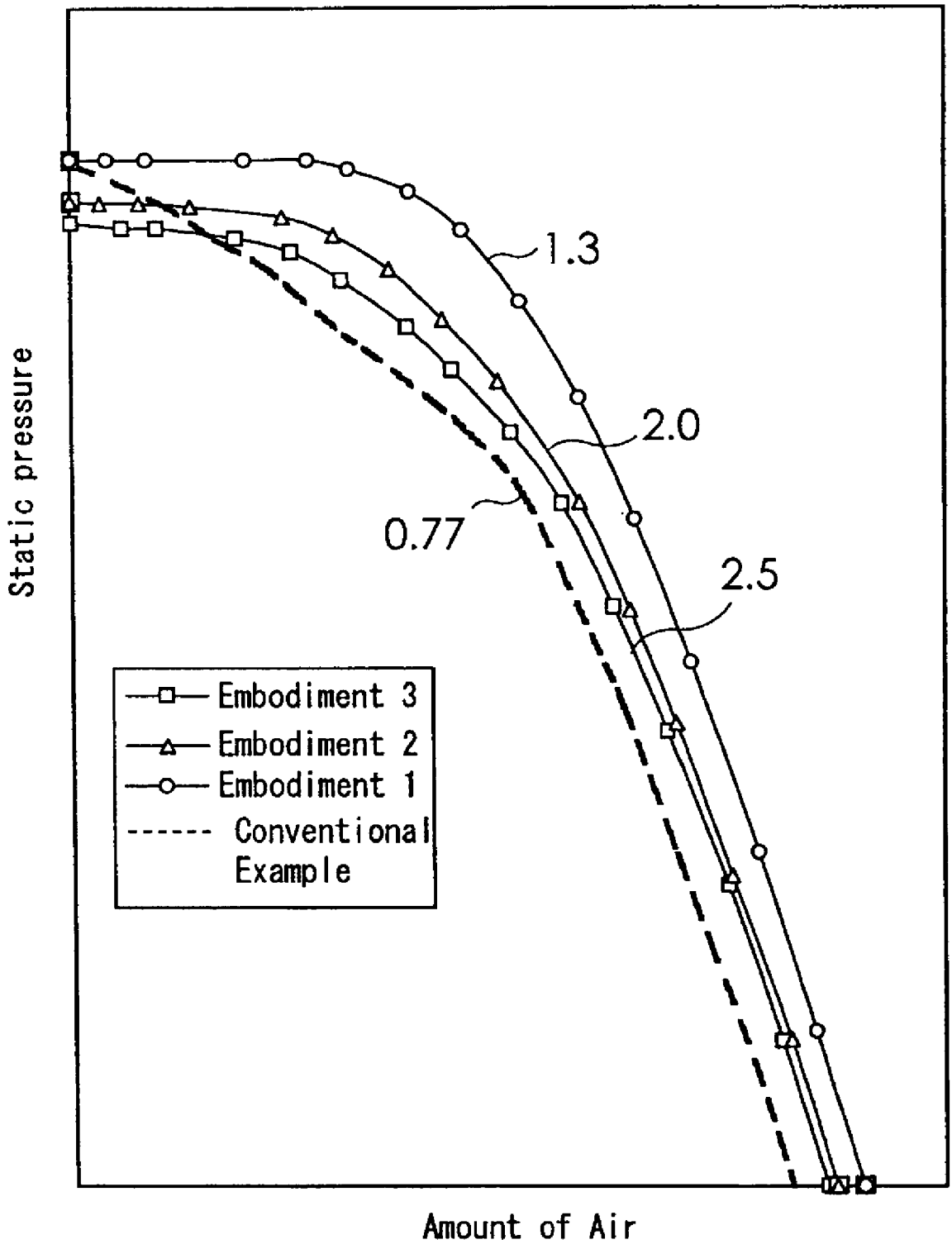
FIG. 7 is a characteristic chart showing the relationship between an amount of air and a static pressure generated by the counter-rotating axial-flow fan having a structure of the present invention, the counter-rotating axial-flow fan of an comparative example and a conventional counter-rotating axial-flow fan.
Figure 8:
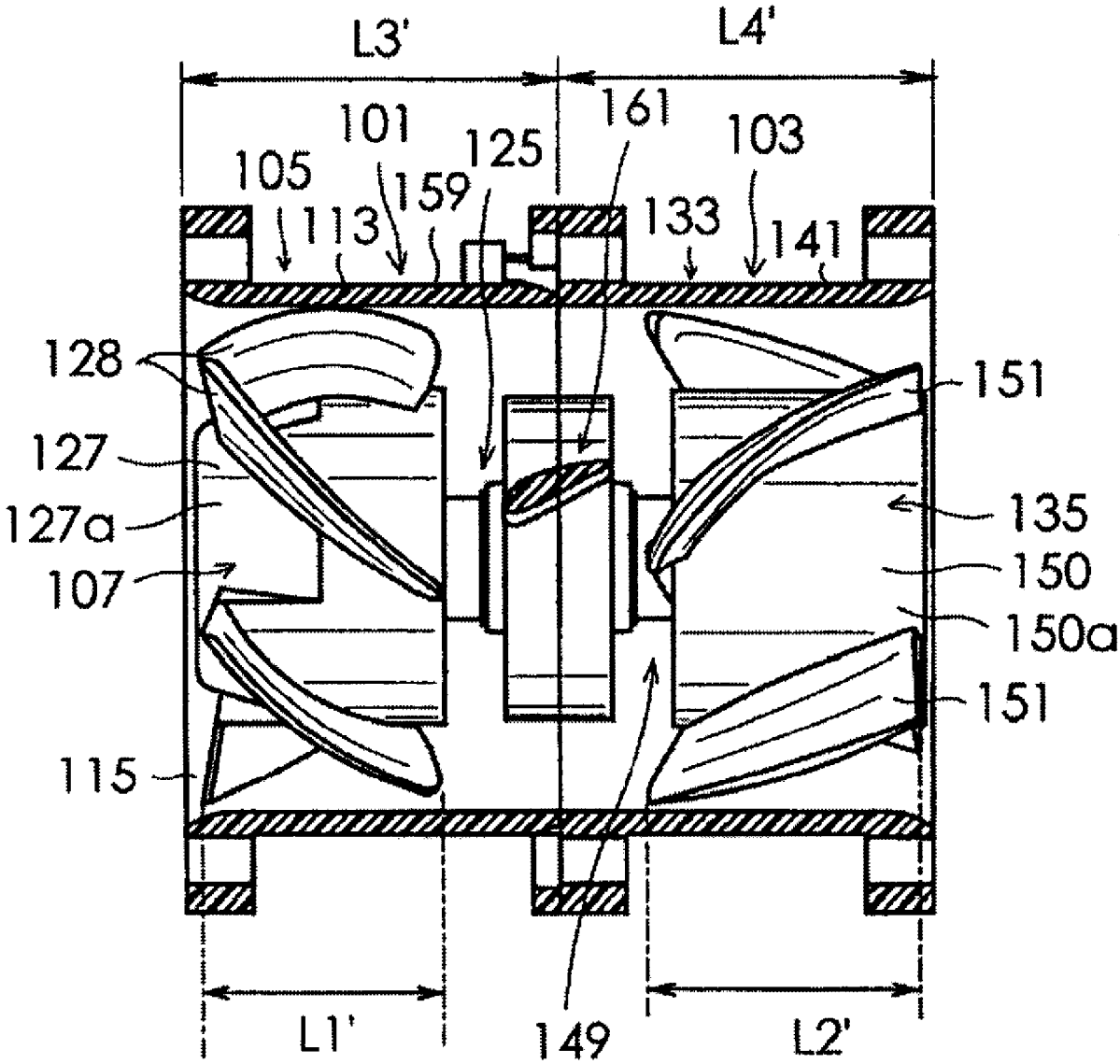
FIG. 8 is a vertical cross-sectional view of the conventional counter-rotating axial-flow fan.

FIG. 7 shows a relationship between an amount of air and a static pressure generated by each of three types of the counter-rotating axial-flow fan. The first one of the three types is the counter-rotating axial-flow fan having a structure of the present invention as shown in FIG. 1 to FIG. 6. The second one of the three types is a counter-rotating axial-flow fan in a comparative example in which a portion, extending beyond the end portion 27*aa* of the peripheral wall 27*a* of the annular member 27 located at the other side (the discharge opening portion 17) in the axial direction, is cut away. The last one is a conventional counter-rotating axial-flow fan as shown in FIG. 8. FIG. 8 shows the counter-rotating axial-flow fan having the conventional structure while FIG. 1 to FIG. 6 show the counter-rotating axial-flow fan having a structure of the present invention. The parts in the FIG. 8 corresponding to those in FIG. 1 to FIG. 6 are indicated with reference numerals each of which is made by adding 100 to each of the reference numerals in FIG. 1 to FIG. 6. Also the reference numerals in FIG. 8, indicating lengths and corresponding to reference numerals in FIG. 2, are indicated by adding dashes to the reference numerals in FIG. 2.

FIG. 7 is a characteristic chart showing the amount of air and the static pressure, when a ratio of a length L1 and a length L2, L1/L2 is varied from 1.3 (Embodiment 1 of the present invention, indicated by a line connecting symbols of ○), 2.0 (Embodiment 2 of the present invention, indicated by a line connecting symbols of Δ), to 2.5 (Embodiment 3 of the present invention, indicated by a line connecting symbols of □).

FIG. 7 also shows the characteristics of the amount of air and the static pressure in the conventional counter-rotating axial-flow fan shown in FIG. 8 using dashed lines.

Table 1 shows an actual length L3 of the first case, an actual length L4 of the second case, and a ratio of L3/L4, as well as an actual length L1 of the front blade an actual length L2 of the rear blade, and a ratio of L1/L2, in connection with the characteristics of the amount of wind and a static pressure shown in FIG. 7.

TABLE 1

| | Ratio of case lengths L3/L4 | Ratio of blade lengths L1/L2 |
|---|---|---|
| Conventional Example | 1 | 0.77 |
| Embodiment 1 | 1.2 | 1.3 |
| Embodiment 2 | 1.5 | 2.0 |
| Embodiment 3 | 1.8 | 2.5 |

As shown most clearly in FIG. 7, it has been found that the characteristics of the amount of air and the static pressure can be improved in the counter-rotating axial-flow fan having a structure of the present invention, compared with those of the comparison examples and the conventional example, when two lengths of L1 and L2 are set so that a ratio of the two lengths L1/L2 is a value from 1.3 to 2.5. A ratio of the length L3 of the first case and the length L4 of the second case, L3/L4, is a value from 1.2 to 1.8.

In other words, of the present invention, the characteristics of the amount of air and the static pressure can be improved when the length L1 of the front blade is longer than the length L2 of the rear blade. The characteristics of the amount of air and the static pressure will be lowered, when the length L1 of the front blade is too long, while the length of the rear blade is too short.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A counter-rotating axial-flow fan comprising:

a housing including an air channel therein, the air channel having a suction opening portion at one side in an axial direction thereof and a discharge opening portion at the other side in the axial direction;

a first impeller including a plurality of front blades and rotating in the suction opening portion;

a first motor that rotates the first impeller about an axial line of the fan in one of two rotating directions;

a second impeller including a plurality of rear blades and rotating in the discharge opening portion;

a second motor that rotates the second impeller about the axial line in the other rotating direction opposite to the one rotating direction; and a plurality of stationary blades radially extending and arranged stationary between the first impeller and the second impeller in the housing;

wherein the number of the front blades is N, the number of the stationary blades is M, and the number of the rear blades is P;

wherein each of N, M, and P is a positive integer and a relationship of N, M and P is N>P>M; and wherein a length, of each of the front blades, L1 measured in the axial direction is longer than a length, of each of the rear blades, L2 measured in the axial direction;

wherein the first impeller includes an annular member having a peripheral wall onto which the N blades are mounted and disposed at a predetermined interval in a circumferential direction;

wherein end portions of the N blades, located at a side to the discharge opening portion, extend toward a direction of the side to the discharge opening portion beyond an end portion of the peripheral wall of the annular member, located at the side to the discharge opening portion;

wherein the second impeller includes annular member having a peripheral wall onto which the P blades are mounted and disposed at a predetermined interval in a circumferential direction; and wherein end portions of the P blades, located at a side to the suction opening portion, do not substantially extend beyond an end portion of the peripheral wall of the annular member located at the side to the suction opening portion, and end portions of the P blades, located at the side to the discharge opening portion, do not substantially extend beyond the end portion of the peripheral wall of the annular member located at the side to the discharge opening portion.

2. The counter-rotating axial-flow fan as defined in claim 1, wherein a length of an extended part for each of the end portions of the N blades, which extends toward the side to the discharge opening portion beyond the end portion of the peripheral wall of the annular member, is within a range from 10 to 15 percent of the length L1.

3. A counter-rotating axial-flow fan comprising:

a housing including an air channel therein, the air channel having a suction opening portion at one side in an axial direction thereof and a discharge opening portion at the other side in the axial direction;

a first impeller including a plurality of front blades and rotating in the suction opening portion;

a first motor that rotates the first impeller about an axial line of the fan in one of two rotating directions;

a second impeller including a plurality of rear blades and rotating in the discharge opening portion;

a second motor that rotates the second impeller about the axial line in the other rotating direction opposite to the one rotating direction; and a plurality of stationary blades radially extending and arranged stationary between the first impeller and the second impeller in the housing, wherein the number of the front blades is 5, the number of the stationary blades is 3, and the number of the rear blades is 4; and wherein a length, of each of the front blades, L1 measured in the axial direction is longer than a length, of each of the rear blades, L2 measured in the axial direction;

wherein the first impeller includes an annular member having a peripheral wall onto which the 5 blades are mounted and disposed at a predetermined interval in a circumferential direction;

wherein end portions of the 5 blades, located at a side to the discharge opening portion, extend toward a direction of the side to the discharge opening portion beyond an end portion of the peripheral wall of the annular member, located at the side to the discharge opening portion;

wherein the second impeller includes an annular member having a peripheral wall onto which the 4 blades are mounted and disposed at a predetermined interval in a circumferential direction;

wherein end portions of the 4 blades, located at a side to the suction opening portion, do not substantially extend beyond an end portion of the peripheral wall of the annular member located at the side to the suction opening portion, and wherein end portions of the 4 blades, located at the side to the discharge opening portion, do not substantially extend beyond the end portions of the peripheral wall of the annular member located at the side to the discharge opening portion.

4. The counter-rotating axial-flow fan as defined in claim 3, wherein a length of an extended part for each of the end portions of the 5 blades, which extends toward the side to the discharge opening portion beyond the end portion of the peripheral wall of the annular member, is within a range from 10 to 15 percent of the length L1.

* * * * *